US010401108B2

(12) United States Patent
Schafer et al.

(10) Patent No.: US 10,401,108 B2
(45) Date of Patent: Sep. 3, 2019

(54) FIRING MECHANISM FOR A FIREARM

(71) Applicant: Q LLC, Portsmouth, NH (US)

(72) Inventors: Nicholas Schafer, Portsmouth, NH (US); Ethan Lessard, East Kingston, NH (US); Brian McDonald, Portsmouth, NH (US)

(73) Assignee: Q, LLC, Portsmouth, NH (US)

( * ) Notice: Subject to any disclaimer, the term of this patent is extended or adjusted under 35 U.S.C. 154(b) by 0 days.

(21) Appl. No.: 15/471,096

(22) Filed: Mar. 28, 2017

(65) Prior Publication Data

US 2018/0195823 A1 Jul. 12, 2018

Related U.S. Application Data

(60) Provisional application No. 62/444,665, filed on Jan. 10, 2017.

(51) Int. Cl.

| | |
|---|---|
| ***F41A 19/30*** | (2006.01) |
| ***F41A 19/31*** | (2006.01) |
| ***F41A 3/22*** | (2006.01) |
| ***F41A 19/10*** | (2006.01) |
| ***F41A 3/72*** | (2006.01) |
| ***F41A 19/12*** | (2006.01) |
| ***F41A 19/34*** | (2006.01) |
| *F41A 3/66* | (2006.01) |

(52) U.S. Cl.

CPC ..... *F41A 19/30* (2013.01); *F41A 3/22* (2013.01); *F41A 3/72* (2013.01); *F41A 19/10* (2013.01); *F41A 19/12* (2013.01); *F41A 19/31* (2013.01); *F41A 19/34* (2013.01); *F41A 3/66* (2013.01)

(58) Field of Classification Search

CPC ..... F41A 19/31; F41A 19/32; F41A 19/44; F41A 19/45; F41A 19/12

See application file for complete search history.

(56) References Cited

U.S. PATENT DOCUMENTS

2011/0174148 A1* 7/2011 Sy ..... F41A 19/04 89/131
2011/0265639 A1* 11/2011 Darian ..... F41A 3/38 89/191.01
2018/0187994 A1* 7/2018 Carr ..... F41A 19/30

* cited by examiner

*Primary Examiner* — J. Woodrow Eldred
(74) *Attorney, Agent, or Firm* — Fox Rothschild LLP

(57) ABSTRACT

The present disclosure relates to a firing mechanism for a firearm, wherein the firing mechanism includes: a housing having a central bore, a cam surface, and a striker sear slot; a striker sear pivotally connected to the housing and positioned within the striker sear slot, the striker sear having a striker head engagement surface; and a striker head movably positioned within the central bore, the striker head having a striker sear engagement surface configured to interface with the striker head engagement surface of the striker sear.

22 Claims, 19 Drawing Sheets

FIRING MECHANISM FOR A FIREARM

INTRODUCTION

Bolt action rifles are firearms where the user must manually cycle the bolt in order to chamber a round of ammunition. Bolt action rifles are commonly used for long range shooting (i.e., hunting, target shooting, etc.). Due to their general simplicity, bolt action rifles are considered to be reliable, accurate, and practical in scenarios where a rapid rate of firing is unneeded.

It is advantageous to equip a bolt action rifle with a trigger mechanism that requires a low pull back force (i.e., a "light" trigger). A trigger with a low pull back force reduces the potential for the user to inadvertently move the rifle slightly during the pull of the trigger. By maintaining a steady rifle, a user increases his/her opportunity to be accurate with firing the rifle.

However, the lighter the trigger, the easier it is for the user to discharge the firearm, either purposely or accidentally. For example, an accidental discharge of the firearm can occur if the firearm is mishandled or dropped, resulting in a dangerous situation. Therefore, improvements in firearm trigger mechanisms are needed.

SUMMARY

The present disclosure relates generally to a trigger mechanism for a firearm. In one aspect, the disclosed technology relates to a firing mechanism for a firearm, the firing mechanism having: a housing having a central bore, a cam surface, and a striker sear slot; a striker sear pivotally connected to the housing and positioned within the striker sear slot, the striker sear having a striker head engagement surface; and a striker head movably positioned within the central bore, the striker head having a striker sear engagement surface configured to interface with the striker head engagement surface of the striker sear. In one embodiment, the housing is generally cylindrical. In another embodiment, the striker head includes a key, and wherein the housing is keyed to accept the key of the striker head. In another embodiment, the cam surface is positioned at an end of the housing, the cam surface having at least one ramp and at least one indentation. In another embodiment, the firing mechanism further includes a striker priming ring positioned around the striker head and engaged with the cam surface of the housing, the striker priming ring having at least one protrusion configured to interface the at least one ramp and at least one indentation of the cam surface. In another embodiment, the striker sear is spring loaded within the housing and biased to a primed position. In another embodiment, when the striker sear is in the primed position, the striker head engagement surface engages with the striker sear engagement surface of the striker head. In another embodiment, the striker sear includes a trigger engagement surface, and the striker sear is rotatable about a striker sear pin away from the primed position when a force is received at the trigger engagement surface. Yet another embodiment relates to a firearm that includes the foregoing firing mechanism.

In another aspect, the disclosed technology relates to a firing mechanism for a firearm, the firing mechanism having: a trigger having a trigger sear, the trigger being spring biased toward a primed position; a striker housing having a central bore, a cam surface, and a striker sear slot; a striker sear pivotally connected to the striker housing and positioned within the striker sear slot, the striker sear having a striker head engagement surface and trigger engagement surface, wherein the trigger engagement surface is configured to receive a force from the trigger sear; and a striker head movably positioned within the central bore, the striker head having a striker sear engagement surface configured to interface with the striker head engagement surface of the striker sear, wherein when the trigger is in a primed position, the trigger sear and the trigger engagement surface of the striker sear are spaced away from one another. In one embodiment, the firing mechanism further includes a striker priming ring positioned around the striker head and engaged with the cam surface of the striker housing, the striker priming ring having at least one protrusion configured to interface within at least one ramp and at least one indentation of the cam surface. In another embodiment, the striker sear is spring loaded within the housing and biased to a primed position, and wherein when the striker sear is in the primed position, the striker head engagement surface engages with the striker sear engagement surface of the striker head. Yet another embodiment relates to a firearm that includes the foregoing firing mechanism.

In another aspect, the disclosed technology relates to a bolt-action firearm having: a receiver for housing a bolt therein; a stock mounted to a rearward end of the receiver; a barrel mounted to a forward end of the receiver; a trigger mounted in the receiver, the trigger having a trigger sear and being spring biased toward a primed position; a striker housing having a central bore, a cam surface, and a striker sear slot, the striker housing being mounted to a rearward end of the bolt; a striker sear pivotally connected to the striker housing and positioned within the striker sear slot, the striker sear having a striker head engagement surface and trigger engagement surface, wherein the trigger engagement surface is configured to receive a force from the trigger sear; and a striker head movably positioned within the central bore, the striker head having a striker sear engagement surface configured to interface with the striker head engagement surface of the striker sear, wherein, when the trigger is in a primed position, the trigger sear and the trigger engagement surface of the striker sear are spaced away from one another. In one embodiment, the bolt-action firearm further includes a striker priming ring positioned in the receiver and around the striker head and engaged with the cam surface of the striker housing, the striker priming ring having at least one protrusion configured to interface within at least one ramp and at least one indentation of the cam surface. In another embodiment, the striker priming ring is spring loaded within the receiver. In another embodiment, the bolt includes a handle affixed thereto. In another embodiment, the striker housing is generally cylindrical. In another embodiment, the striker head includes a key, and the striker housing is keyed to accepted the key of the striker head.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings.

DETAILED DESCRIPTION

Figure 1:
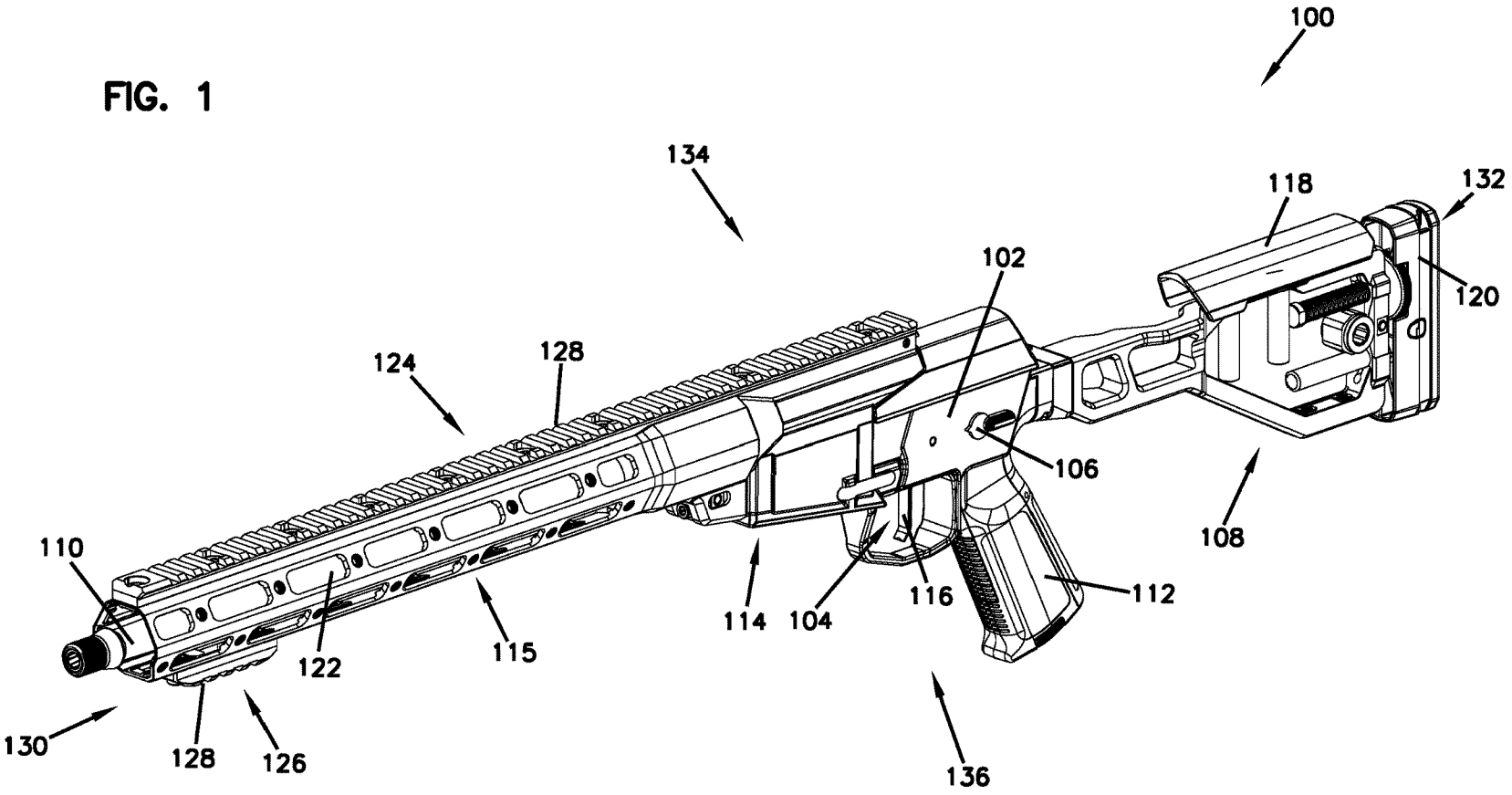
FIG. 1 illustrates a perspective view of an example firearm, according to one embodiment of the present disclosure.
Figure 2:
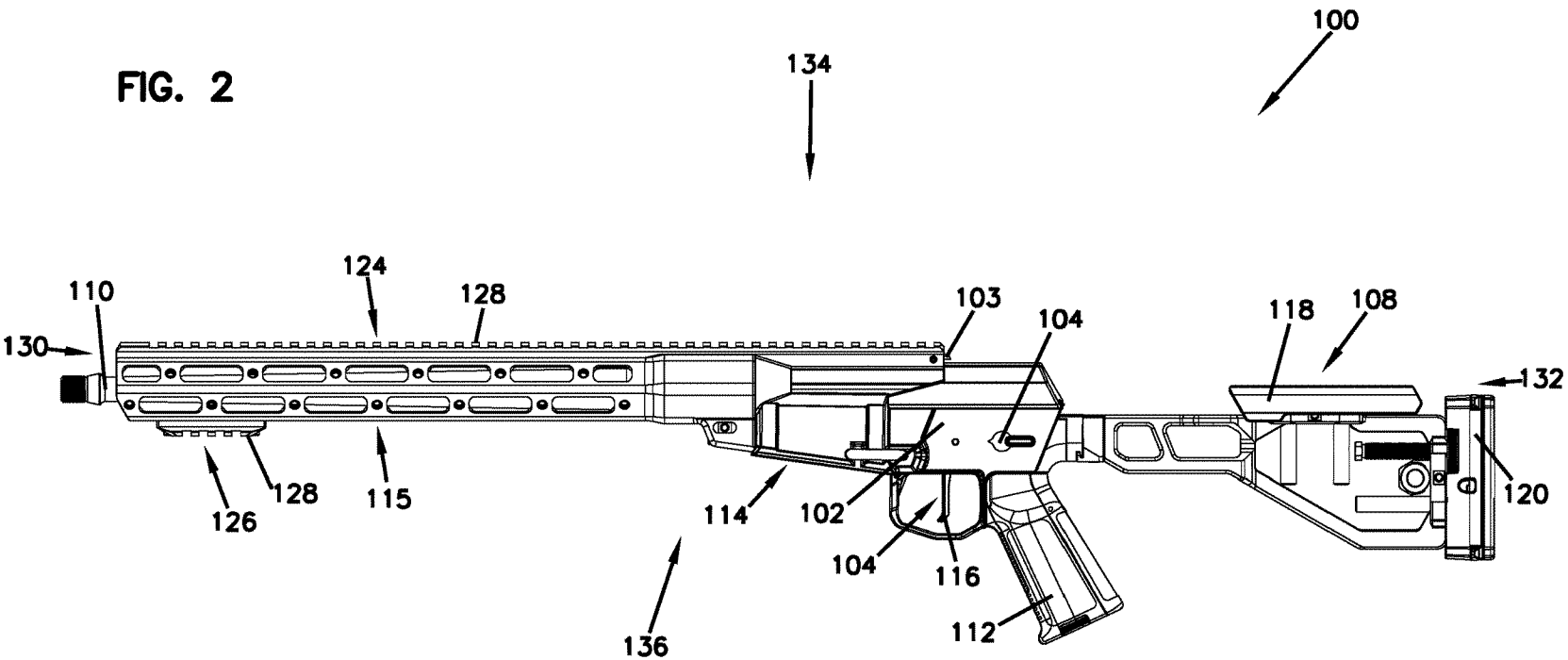
FIG. 2 illustrates a user's left side view of the firearm of FIG. 1.

Various embodiments will be described in detail with reference to the drawings, wherein like reference numerals represent like parts and assemblies throughout the several views.

Reference to various embodiments does not limit the scope of the claims attached hereto. Additionally, any examples set forth in this specification are not intended to be limiting and merely set forth some of the many possible embodiments for the appended claims.

FIG. 1 is a perspective view of an example firearm 100. In this example, the firearm 100 includes a receiver 102. The receiver 102 includes a trigger mechanism 104 and a safety mechanism 106. In some embodiments, the firearm 100 may also include a stock 108, a barrel 110, a grip 112, a magazine well 114, and a rail 115. In some embodiments, the firearm 100 is at least partially ornamental in nature and features nonfunctional elements.

The firearm 100 includes a front 130, a rear 132, a top 134, and a bottom 136. Throughout this disclosure, references to orientation (e.g., front(ward), rear(ward), in front, behind, above, below, high, low, back, top, bottom, under, underside, etc.) of structural components shall be defined by that component's positioning in FIG. 1 relative to, as applicable, the front 130, rear 132, top 134, and bottom 136 of the firearm 100, regardless of how the firearm 100 may be held and regardless of how that component may be situated on its own (i.e., when separated from the firearm 100).

The firearm 100 is configured to have a plurality of operating modes. For example, the operating modes include at least a safe mode and a fire mode.

The firearm 100 is a bolt action rifle. As will be described in more detail herein, a bolt assembly is manually movable by the user to feed a single round of ammunition into the receiver for firing. Once the round of ammunition is discharged, the bolt assembly is manually retracted so as to eject the spent round of ammunition from the receiver. The bolt assembly can then be manually moved forward to feed another round of ammunition into the receiver, and the process can be repeated as the user desires.

Figure 3:
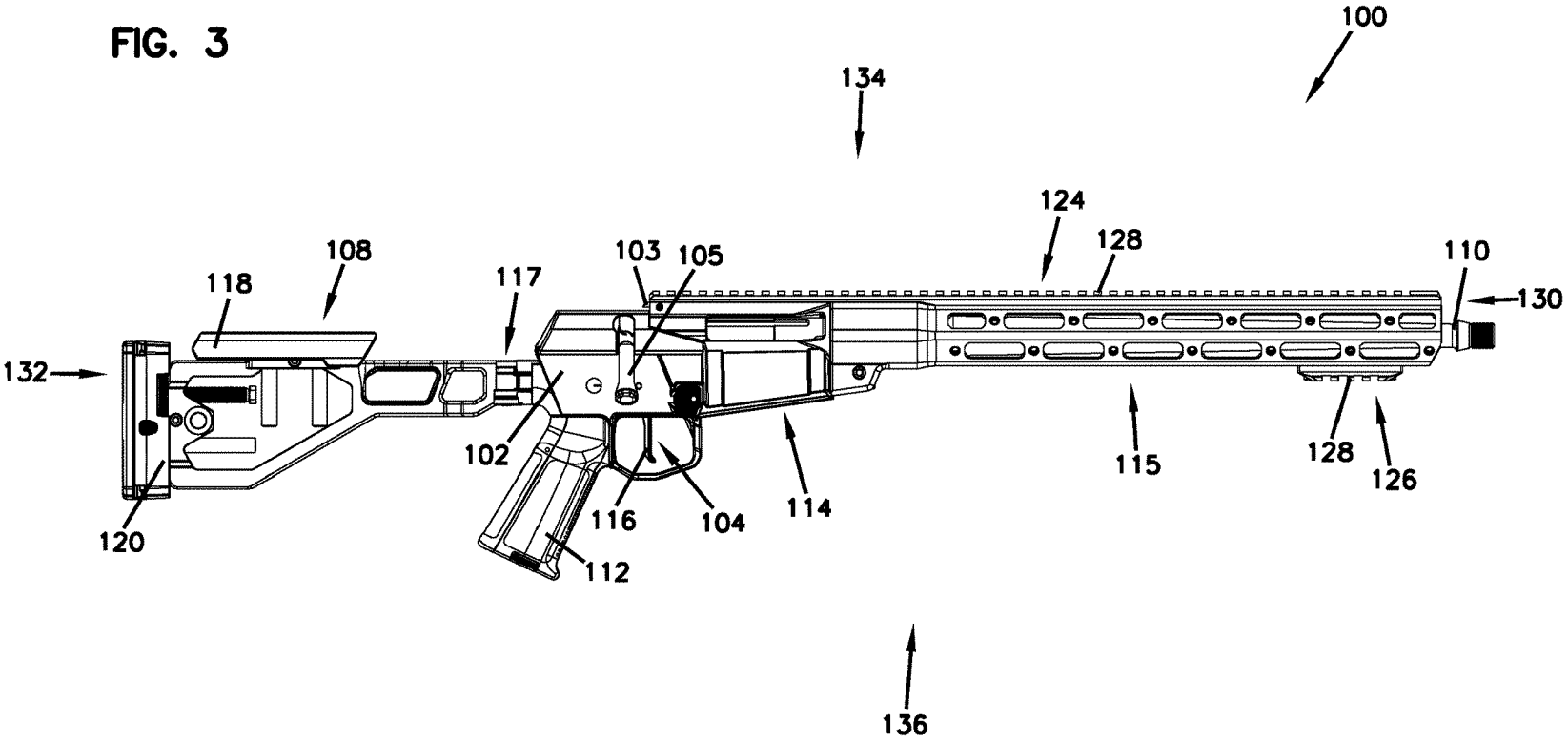
FIG. 3 illustrates a user's right side view of the firearm of FIG. 1.

The receiver 102 is configured to house a firing mechanism 101 and associated components. The firing mechanism 101 includes the trigger mechanism 104, which is described and illustrated in more detail with reference to FIGS. 19-21. A bolt assembly 150 (shown, for example, in FIGS. 6-9) can also be slidably disposed in the receiver 102. A handle 105 (shown, for example, in FIG. 3) is attached to the bolt assembly 150 and can be used to manually rotate and move the bolt assembly 150 within the receiver 102. The bolt assembly 150 is configured to interface with the trigger mechanism 104. The bolt assembly 150 can be removed from the receiver by way of a bolt release button 103.

The trigger mechanism 104 includes a trigger bow 116 that is configured to be pulled by the finger of the user (e.g., the index finger) to fire the firearm 100. The trigger bow 116 is pivotally mounted in the receiver 102. The trigger bow 116 can be a variety of different shapes. The trigger mechanism 104 is configured to discharge the firearm 100 when a predetermined amount of force is applied to the trigger bow 116.

The safety mechanism 106 is configured to facilitate the switching of the firearm 100 between different operating modes. In at least one example, the safety mechanism 106 is a safety mechanism lever that is switchable between multiple positions, such as a fire mode position and a safe mode position. The safety mechanism 106 is in communication (i.e. in periodic contact) with the trigger mechanism 104 so as to control the operation of the trigger mechanism 104. Further, the safety mechanism 106 is disposed in the side of the receiver 102.

The stock 108 is configured to be positioned at the rear 132 of the firearm 100. The stock 108 provides an additional surface for a user to support the firearm 100, preferably against the user's shoulder. In some examples, the stock 108 is foldable about a hinge 117 (shown in FIG. 3). In some examples, the stock 108 includes an adjustable cheek pad 118 and an adjustable recoil pad 120. In some examples, the stock 108 has a skeleton construction to minimize weight. For example, the skeleton construction of the stock 108 can include only the main frame members of the stock 108 to maintain the general shape of the stock 108, without including an extra skin or cover.

The barrel 110 is positioned at the front 130 of the firearm 100 and is configured to be installed on the receiver 102. The barrel 110 provides a path for release of an explosion gas and a projectile propelled therethrough. In some examples, the barrel 110 is readily removable from the receiver 102. For example, a user can choose from multiple barrels 110 that are each configured to operate with different calibers of ammunition. The rail 115 can be mounted around the barrel 110 and include a system for mounting accessories (e.g., a bi-pod, a laser, optics equipment, etc.) thereto. In some examples, the front end of the barrel 110 protrudes from the rail 115 and is threaded.

The grip 112 provides a point of support for the user of the firearm 100 and can be held by the user's hand, including when operating the trigger mechanism 104. The grip 112 assists the user in stabilizing the firearm 100 during firing and handling. In some embodiments, the grip 112 is mounted to the receiver 102.

The magazine well 114 is configured to receive a magazine for ammunition storage. The magazine well 114 allows for a magazine to access the bolt assembly and internal portion of the receiver 102.

The rail 115 (also known as a handguard) surrounds at least a portion of the barrel 110 and can function as a support for the user's front hand when firing the firearm 100. The rail 115 may also act to prevent the user's hand from getting burned by the barrel 110. As discussed above, the rail 115 may also be used for mounting accessories. The rail 115 can be mounted to the barrel 110 (e.g., with a barrel nut) such that the rail 115 abuts the receiver 102. In some examples, the rail 115 includes apertures 122 that aid in reducing the weight of the rail 115 and also serve as heat vents, thereby helping to prevent excessive heat build-up between the rail 115 and the barrel 110. In the depicted example, a top surface 124 and a bottom surface 126 of the rail 115 include mounting ribs 128. At the top surface 124, the ribs 128 run the length of the rail 115. At the bottom surface 126, the ribs 128 are positioned toward a front end of the firearm 100. The mounting ribs 128 provide a platform for mounting firearm accessories on the rail 115. In one example, the mounting ribs 128 are standard dimension such as a "Picatinny" style mounting platform, also known as MIL-STD-1913.

Other embodiments of the firearm 100 have other configurations than those illustrated and described with reference to FIG. 1. For example, some of the components listed above (e.g., rail, stock, grip etc.) are not included in some alternative embodiments.

Figure 4:
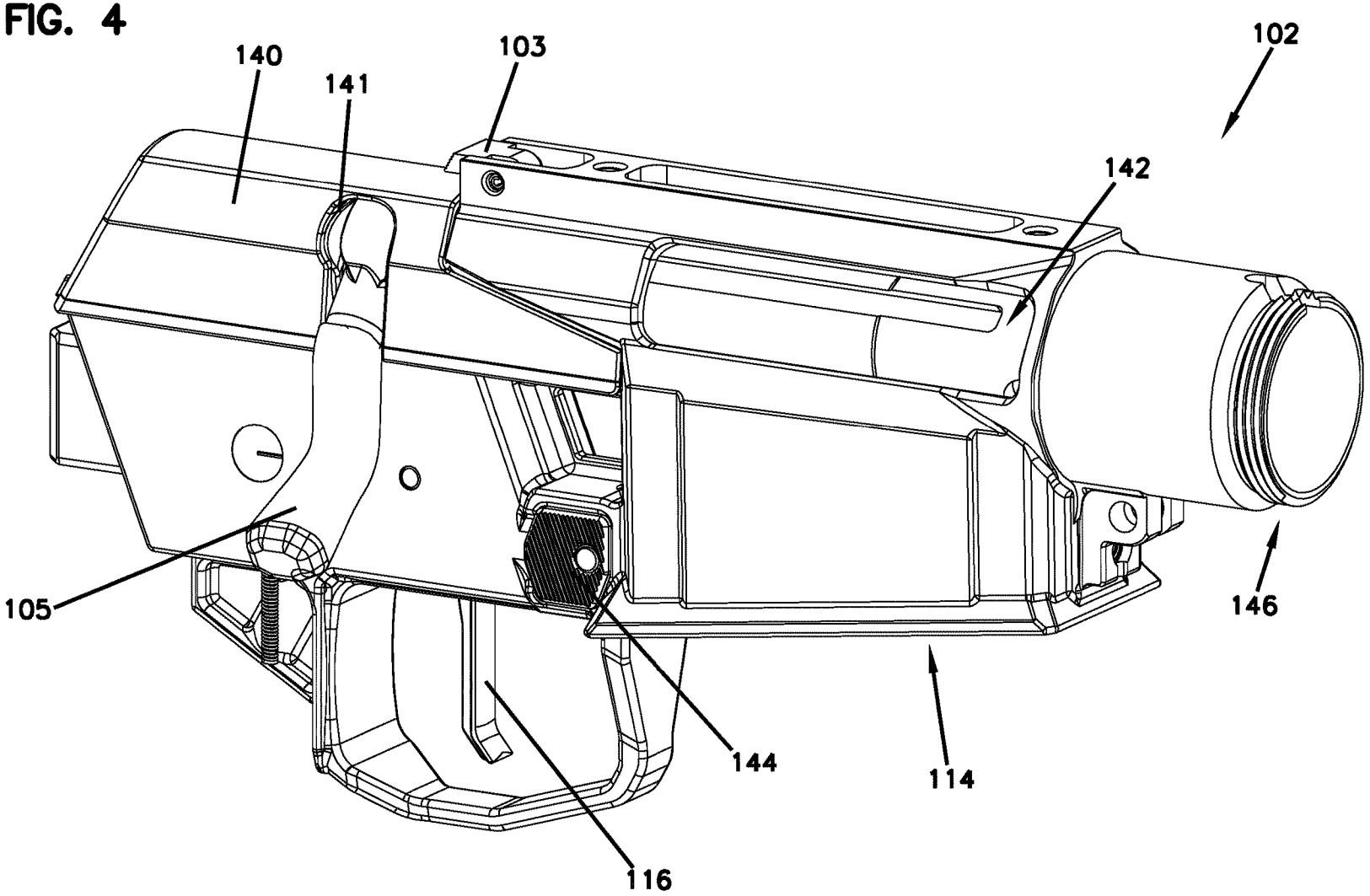
FIG. 4 illustrates a perspective view of a firearm receiver, according to one embodiment of the present disclosure.

FIG. 4 shows a perspective view of an example of the receiver 102, which is shown as further including a bolt shroud 140, an ejection port 142, a magazine release 144, and a threaded barrel interface 146.

The bolt shroud 140 surrounds the bolt assembly 150 (shown in FIG. 6) and can slide with the handle 105 and the bolt assembly 150 when the user cycles the bolt assembly 150 during a firing sequence. The bolt shroud 140 includes a slot 141 so that the handle 105 may be partially rotated in an upward and downward motion within the slot 141.

The ejection port 142 allows for the ejection of spent cartridges from the receiver 102 during the firing cycle of the firearm 100.

The magazine release 144 is a button that is configured to release a magazine from the magazine well 114. The magazine release 144 is positioned adjacent the trigger bow 116 to allow the user to easily reach the magazine release 144 without excessive maneuvering.

The threaded barrel interface 146 is configured to receive and attach the barrel 110 to the receiver 102. In some examples, the threaded barrel interface 146 is configured to interface with a barrel nut (not shown).

Figure 5:
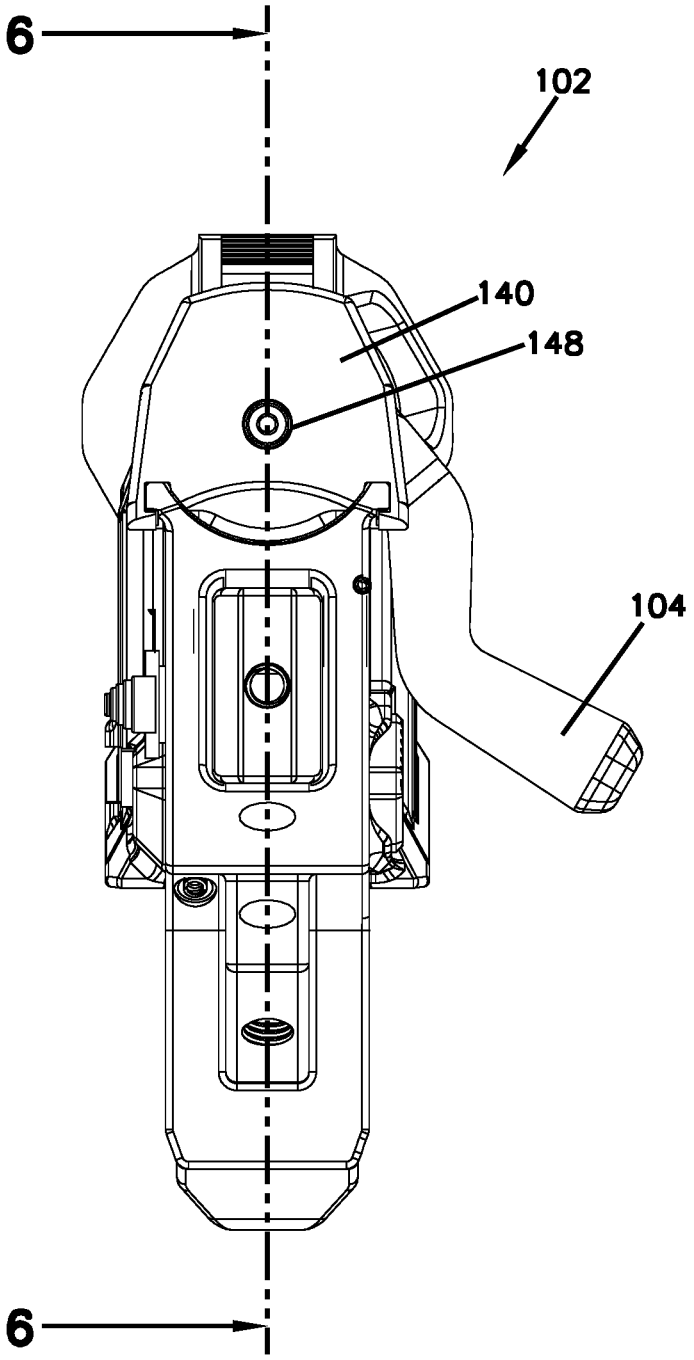
FIG. 5 illustrates a rear view of the firearm receiver of FIG. 4.

FIG. 5 shows the rear of an example of the receiver 102. In this example, the bolt shroud 140 includes an aperture 148 at the rear of the bolt shroud; and the aperture 148 is configured to provide an indication that the firearm 100 is in a primed position. A primed position is a ready-to-fire state which is when the firearm 100 will discharge a round of ammunition if the safety mechanism 106 is in the fire position and the trigger bow 116 is pulled to the rear 132 of the firearm 100. In some examples, a portion of the bolt assembly 150 will protrude, or otherwise appear, in the aperture 148 when the firearm 100 is in a primed position.

Figure 6:
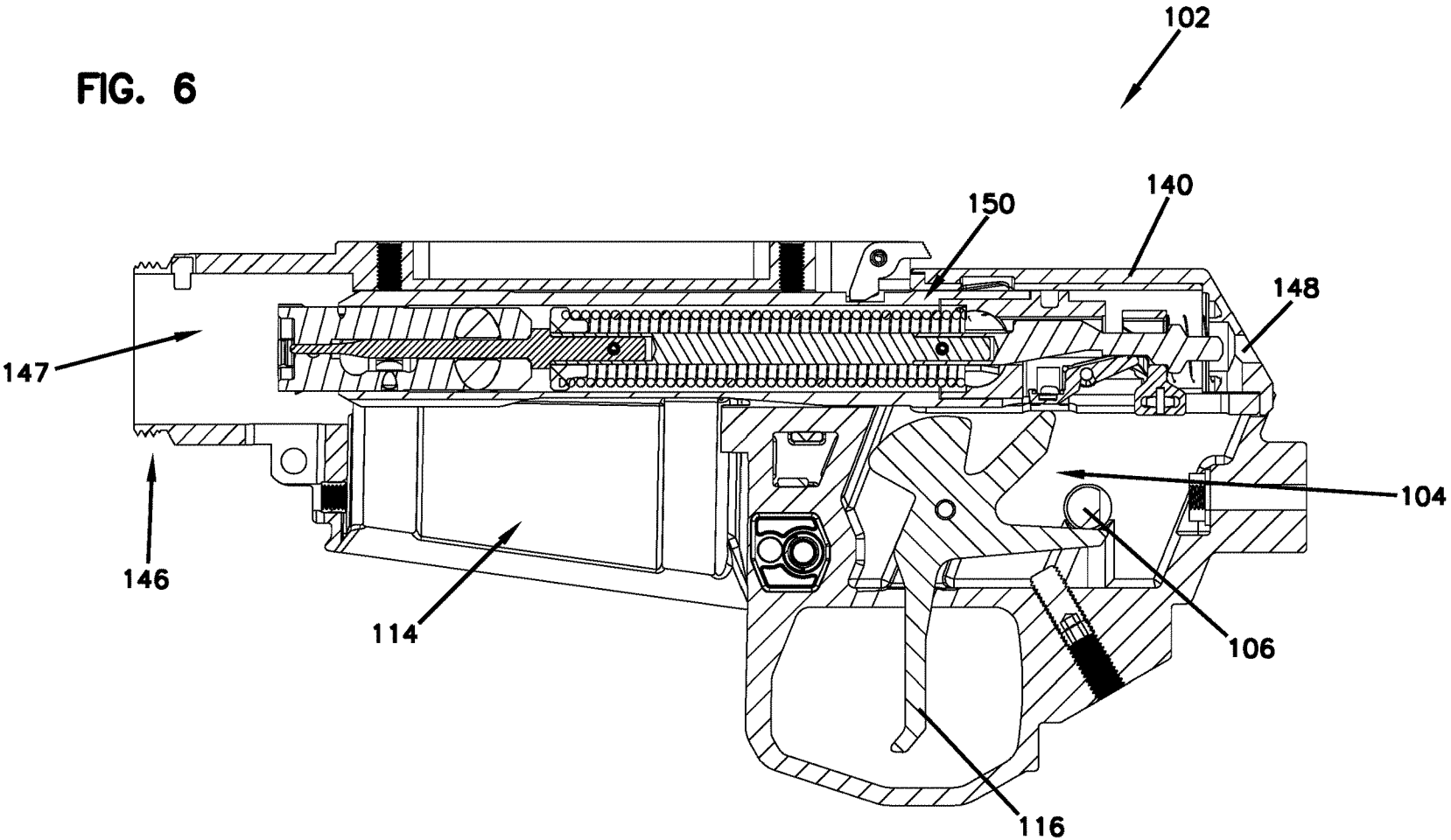
FIG. 6 illustrates a cross-sectional view along line 6-6 of the firearm receiver of FIG. 4.

FIG. 6 shows a cross-sectional view of the receiver 102 along line 6-6 in FIG. 5. Slidably disposed within a central bore 147 in the receiver 102 is the bolt assembly 150. As noted above, the bolt assembly 150 is manually movable within the receiver 102 in order to fire the firearm 100.

Figure 7:
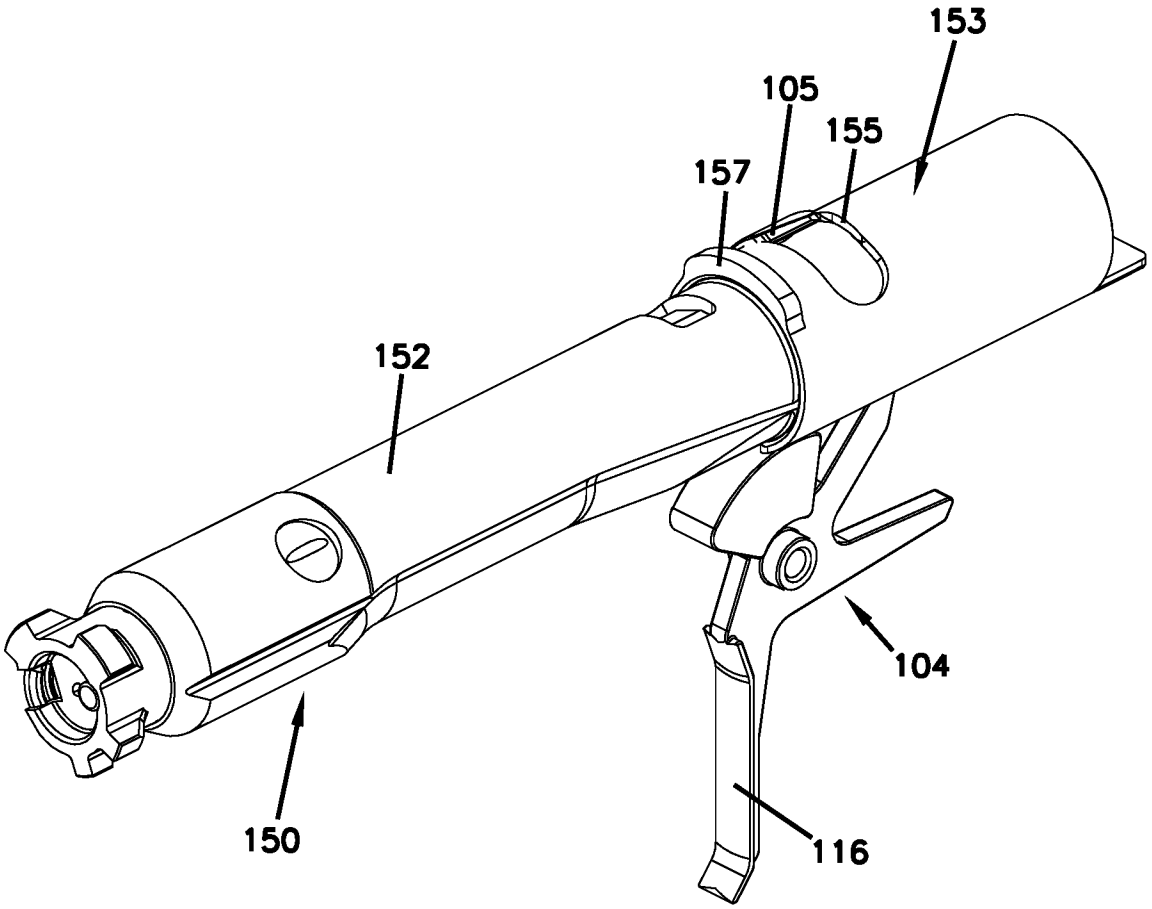
FIG. 7 illustrates a perspective view of a bolt assembly, according to one embodiment of the present disclosure.
Figure 8:
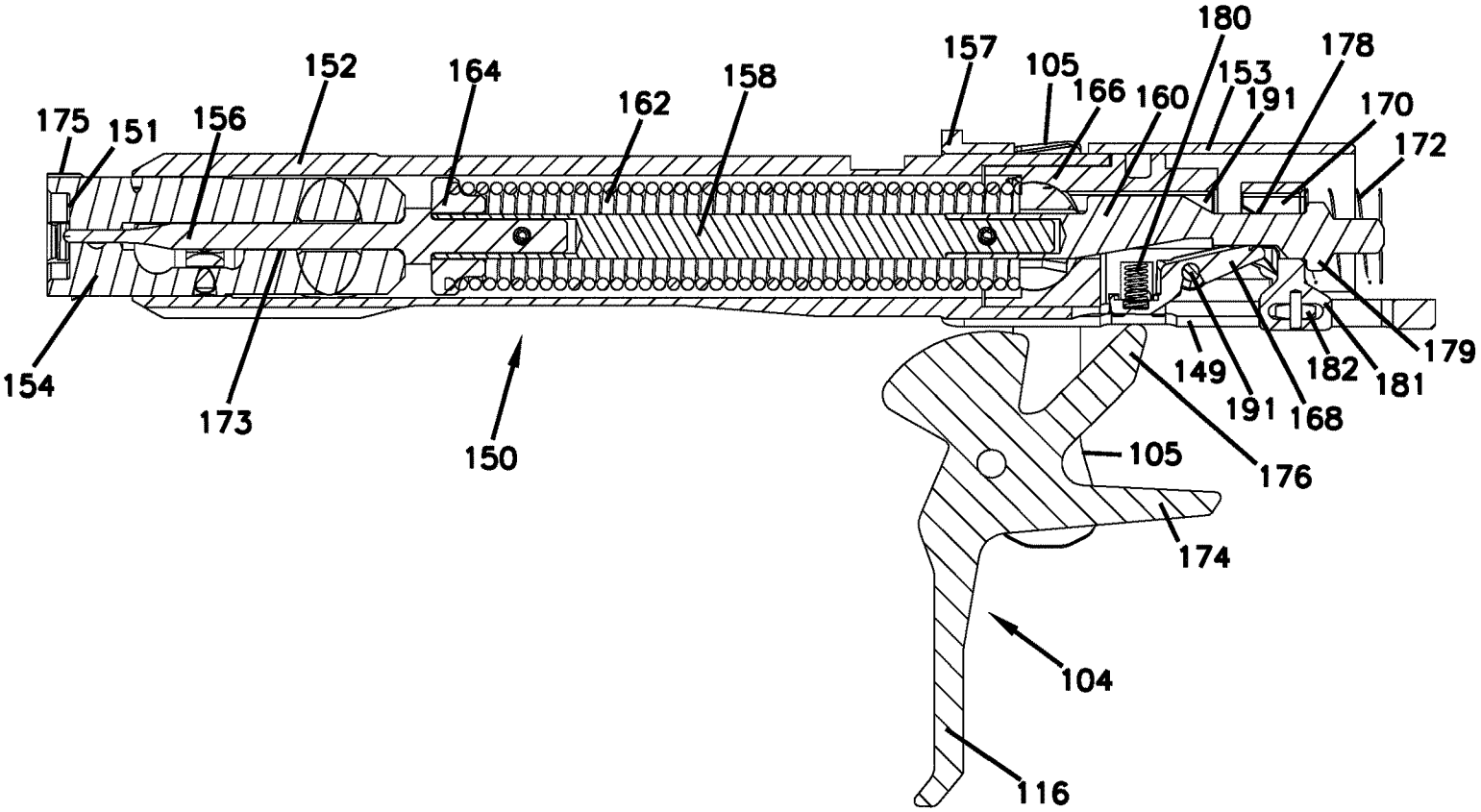
FIG. 8 illustrates a longitudinal cross-sectional view of the bolt assembly of FIG. 7.

FIG. 7 shows a perspective view of an example of the bolt assembly 150 and the trigger mechanism 104. FIG. 8 shows a longitudinal cross-section of an example of the bolt assembly 150 and the trigger mechanism 104. The bolt assembly 150 includes a bolt body 152, a priming body 153, a bolt head 154, a striker tip 156, a striker shaft 158, a striker head 160, a striker spring 162, a striker spring retainer 164, a striker cam 166, a striker sear 168, striker priming ring 170, and a striker priming ring spring 172. The trigger mechanism 104 includes the trigger bow 116, a safety arm 174, and a trigger sear arm 176.

While the bolt assembly 150 is movable within the receiver 102, the striker tip 156, striker shaft 158, and striker head 160 are movable within the bolt assembly 150 to facilitate the discharging of a round of ammunition. For example, to fire a round of ammunition, the striker tip 156 must protrude from a face 151 of the bolt head 154 (as shown in FIG. 8) so as to strike a rear portion of a round of ammunition that is seated within the receiver 102. The movement of the striker tip 156 is generally facilitated by the striker spring 162 and the movement of the trigger mechanism 104. When not primed to fire, the striker tip 156 does not protrude from the face 151 of the bolt head 154, as shown in FIG. 7.

The bolt body 152 and the priming body 153 serve as the outer shell for the bolt assembly 150. The bolt body 152 is attached to the bolt head 154. The bolt body 152 is secured within the priming body 153 by way of the handle 105. However, the bolt body 152 is partially rotatable within the priming body 153.

The priming body 153 includes an aperture 155 to receive the handle 105 therethrough. The handle 105 is configured to be rotated about a longitudinal axis of the priming body 153 within the aperture 155 and without rotating the priming body 153. The priming body 153 also includes a projection 157 that helps to retain the bolt assembly 150 within the receiver 102. The priming body 153 further includes an opening 149 adjacent the trigger mechanism 104 so as to allow the trigger mechanism 104 to communicate with the bolt assembly 150.

The bolt head 154 includes a central bore 173 so as to allow the striker tip 156 to slidably move therein. The bolt head 154 can also include a plurality of lugs 175 for interfacing with the barrel 110 of the firearm 100 during the firing sequence.

The striker tip 156, striker shaft 158, and striker head 160 are separate parts connected to one another—e.g., as shown in FIG. 8, the striker tip 156 and the striker head 160 are connected via the striker shaft 158. The striker tip 156, striker shaft 158, and striker head 160 are propelled within the bolt assembly 150 by way of the striker spring 162 that is positioned around the striker tip 156, striker shaft 158, and striker head 160 and retained within the bolt assembly 150 between the striker spring retainer 164 and the striker cam 166. The striker spring retainer 164 is movable longitudinally in the bolt assembly 150 with the striker tip 156, striker shaft 158, and striker head 160; however, the striker cam 166 is not movable longitudinally in the bolt assembly 150 with the striker tip 156, striker shaft 158, and striker head 160. The striker spring retainer 164 is seated against the striker tip 156 and around the striker shaft 158 so that, as the striker spring 162 compresses and decompresses, the striker spring retainer 164 moves with the striker spring 162 and transfers forces from the striker spring 162 to the striker tip 156, striker shaft 158, and striker head 160.

The striker cam 166 provides just one example of a housing for the pivotal attachment of the striker sear 168 and positioning of the striker head 160. In another example, a housing for the pivotal attachment of the striker sear 168 and positioning of the striker head 160 can be a separately formed piece attached to the striker cam 166. Other housings are also possible.

The striker cam 166 is secured within an end of bolt body 152 opposite the bolt head 154 in the bolt assembly 150. The striker cam 166 is also positioned within the priming body 153 by way of the handle 105. The striker cam 166 further includes a central bore 177. The striker cam 166, striker sear 168, and striker priming ring 170 facilitate the priming of the striker tip 156, striker shaft 158, and striker head 160 and control the release thereof.

The striker sear 168 is pivotable about a pin 191 within the striker cam 166. Further, the striker sear 168 is spring loaded by way of a spring 180 in a rotatable position toward the striker head 160. The striker sear 168 is configured to interface with the striker head 160 and the trigger mechanism 104, specifically the trigger sear arm 176, so as to facilitate the release of the striker head 160 from the primed position to a fired position. Such movement will be discussed in more detail with respect to FIGS. 19-21.

The striker priming ring 170 is positioned at the rear of the striker cam 166. The striker priming ring 170 is configured to movably abut the striker cam 166. The striker priming ring 170 includes a central bore 178 in which the striker head 160 is positioned. The striker head 160 is secured within the striker priming ring 170 by way of a flange 179 which is sized larger than the central bore 178 of the striker priming ring 170 and posited at the rear of the striker priming ring 170. The striker priming ring 170 is biased against the striker cam 166 by way of the striker priming ring spring 172. The striker priming ring 170 is positioned within the opening 149 of the priming body 153 by way of an extension 181. The extension 181 includes a roller 182, so as to allow the striker priming ring 170 to move smoothly longitudinally within the opening 149.

When the bolt assembly 150 is rotated by the handle 105, the striker cam 166 interfaces with the striker priming ring 170, pushing the striker priming ring 170 to the rear 132 of the firearm 100 as the striker cam 166 rotates within the bolt assembly 150. The bolt assembly 150 rotates about the priming body 153, which houses the striker priming ring 170. Due to the flange 179 of the striker head 160, the striker head 160 moves with the striker priming ring 170 to the rear 132 of the firearm 100. Because the striker cam 166 does not move longitudinally with the striker priming ring 170, and because the striker spring retainer 164 is seated against the striker tip 156, which is connected to the striker head 160, the movement of the striker head 160 toward the rear 132 compresses the striker spring 162 when the bolt assembly 150 rotates. Simultaneously, the striker sear 168 rotates toward the striker head 160 and catches the striker head 160, thereby locking the striker head 160 into the primed position.

Figure 9:
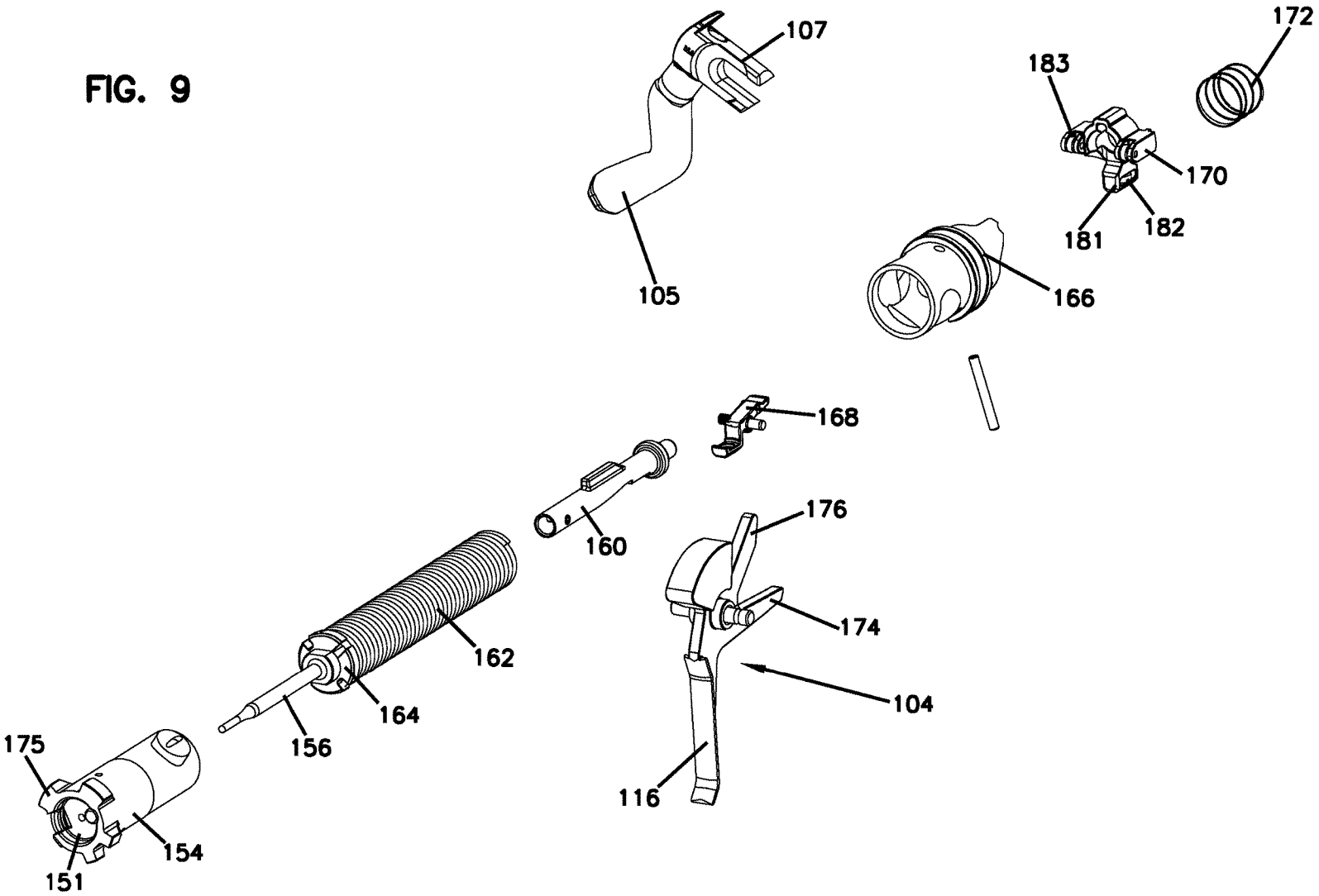
FIG. 9 illustrates an exploded perspective view of a portion of the bolt assembly of FIG. 7.

FIG. 9 shows an exploded view of a portion of an example of the bolt assembly 150, wherein the handle 105 is shown as including an extension 107 configured to pass through the bolt body 152, the priming body 153, and the striker cam 166 in order to secure each to one another to prevent longitudinal movement with respect to one another. The striker priming ring 170 is shown to include a pair of rollers 183 that are configured to interface with the striker cam 166. The bolt head 154 is shown spaced away from the striker spring 162, striker spring retainer 164, and striker tip 156. The striker head 160 is shown separated from the striker sear 168 and the striker cam 166.

Figure 10:
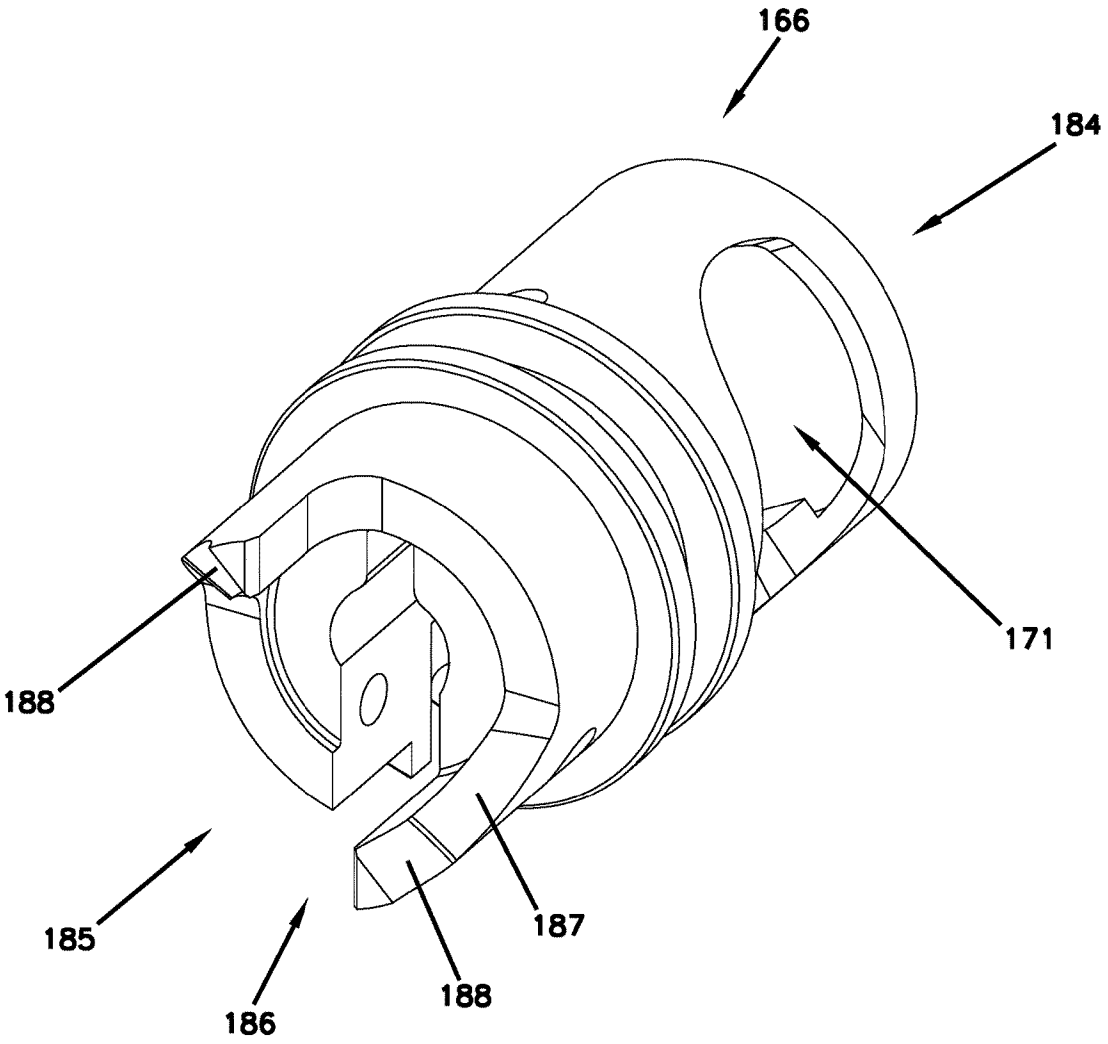
FIG. 10 illustrates a front perspective view of a striker cam, according to one embodiment of the present disclosure.
Figure 11:
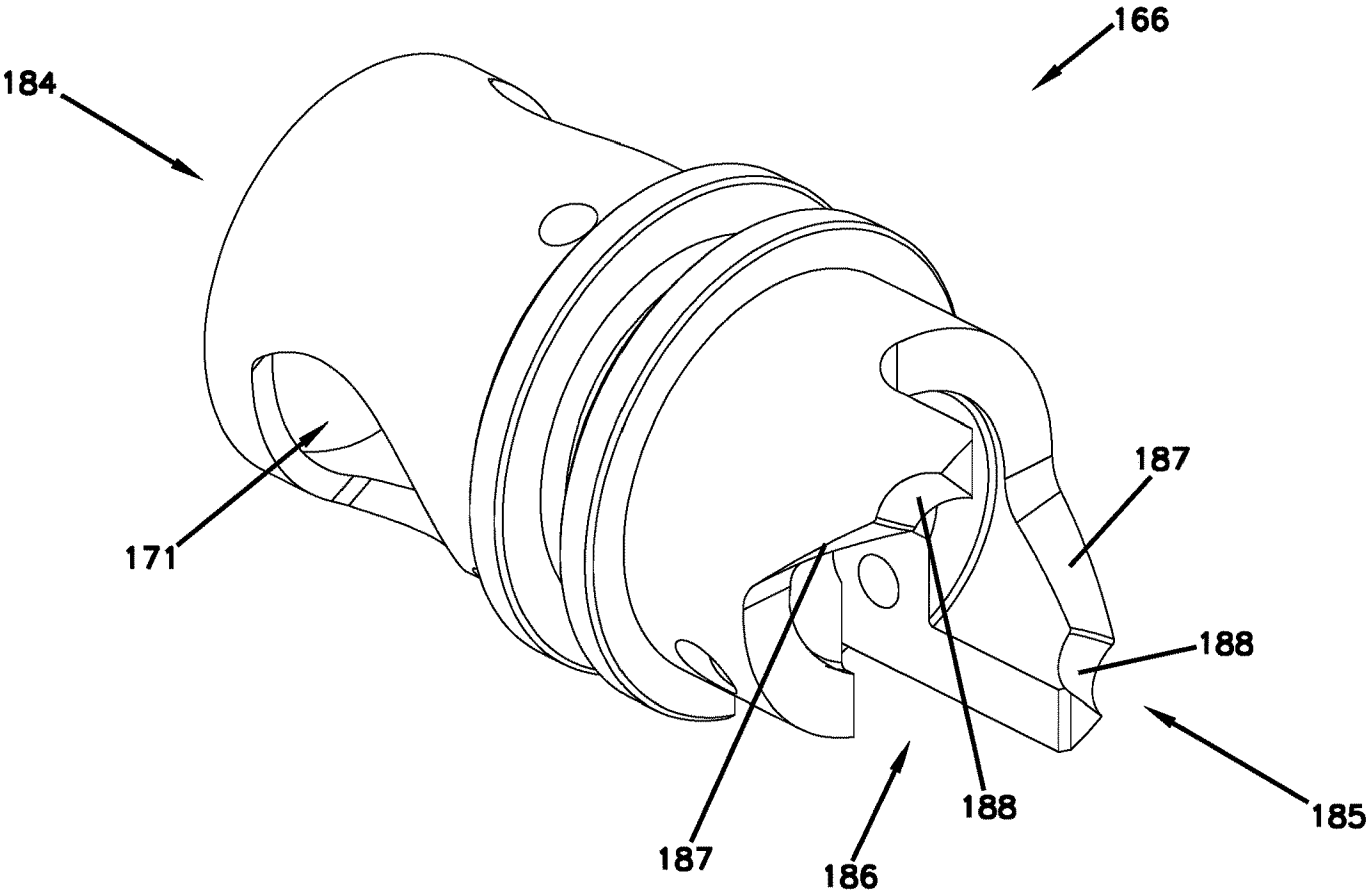
FIG. 11 illustrates a rear perspective view of the striker cam of FIG. 10.

FIGS. 10 and 11 show perspective views of an example of the striker cam 166. The striker cam 166 includes a front 184 and a rear 185, each corresponding with the front 130 and rear 132 of the firearm 100. The striker cam 166 includes a cam surface 186 at the rear 185 and a transverse aperture 171 configured to receive the handle extension 107.

The cam surface 186 includes at least one ramp 187 and at least one indentation 188. In the depicted example, the cam surface includes a pair of ramps 187 and a pair of indentations 188. In at least one embodiment, there is the same number of ramps and indentations. The ramps 187 and indentations 188 are configured to receive the rollers 183 of the striker priming ring 170. Specifically, the rollers 183 are configured to travel along the ramps 187 until they reach the indentations 188 as the striker cam 166 is rotated by the handle 105. The rotation of the striker cam 166 and the interfacing of the cam surface 186 with the rollers 183 causes the striker priming ring 170 to move away from the striker cam 166, thereby facilitating the priming of the striker head 160, as described above.

Figure 12:
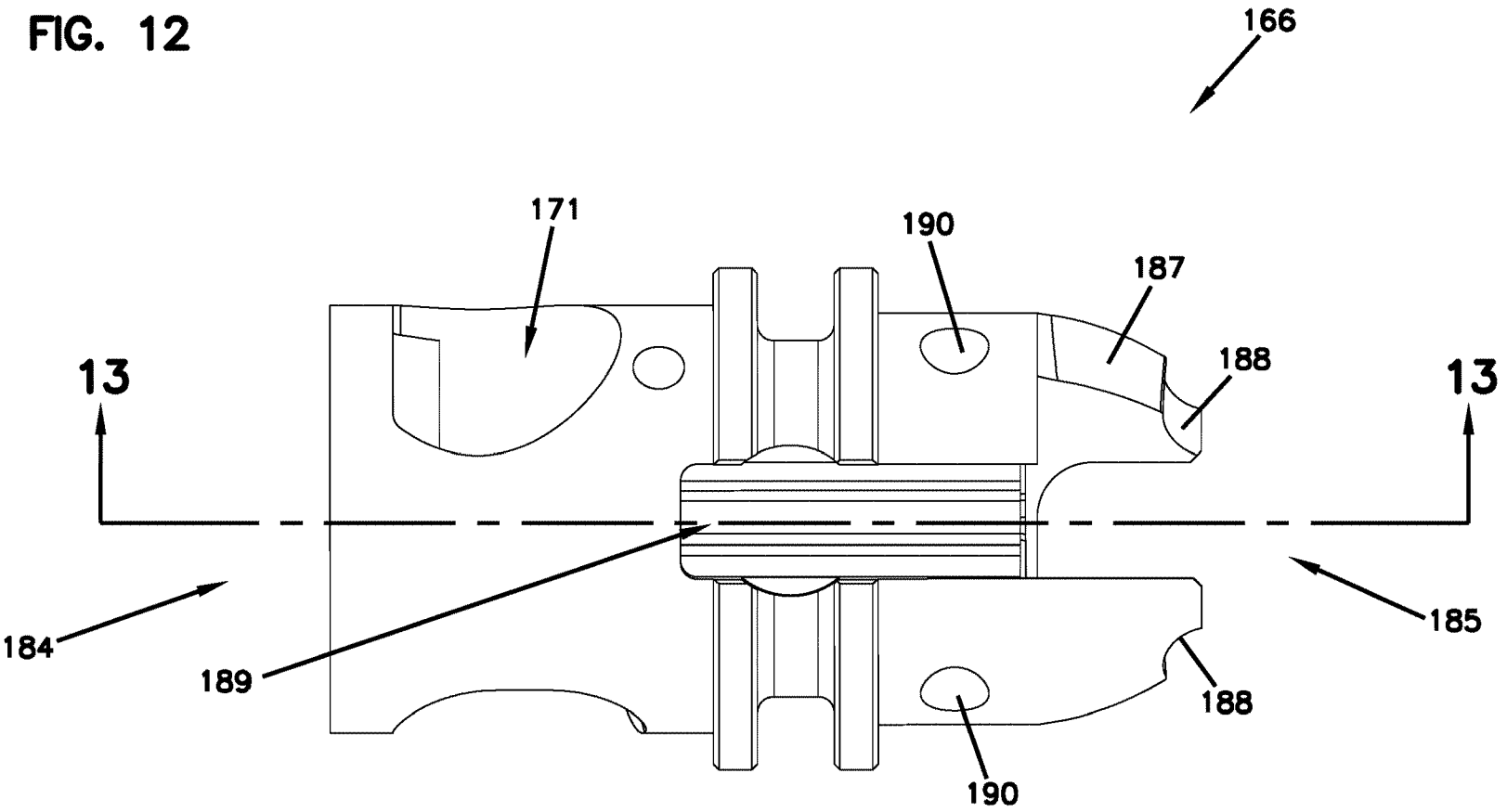
FIG. 12 illustrates a rear perspective view of the striker cam of FIG. 10.

FIG. 12 shows a bottom view of the striker cam 166. The striker cam 166 includes a striker sear slot 189 that is longitudinally positioned in the bottom of the striker cam 166. The striker sear slot 189 is configured to pivotally house the striker sear 168. The striker cam 166 also includes a striker sear pivot aperture 190 configured to receive a pin to secure the striker sear 168 within the slot 189.

Figure 13:
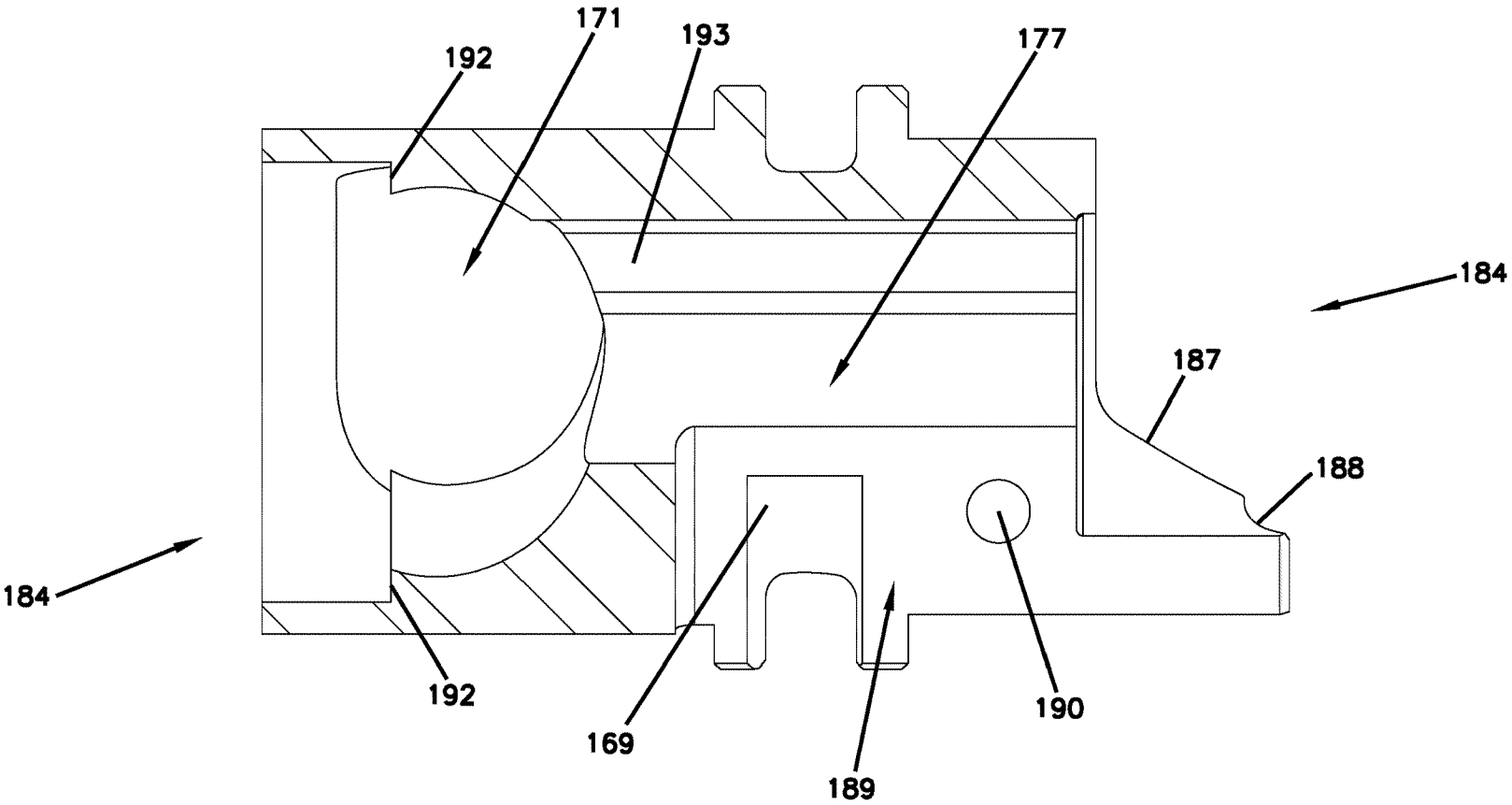
FIG. 13 illustrates a cross-sectional view along line 13-13 of the striker cam of FIG. 10.

FIG. 13 shows a cross-section along line 13-13 in FIG. 12. The striker cam 166 further includes the central bore 177 that is configured to slidably house the striker head 160. In the depicted example, the central bore 177 includes a keyed slot 193. The central bore is configured to receive the striker head 160. The central bore 177 can include a lip 192 at the front of the striker cam 166 to receive the striker spring 162 (as shown in FIG. 8). The striker cam 166 also includes a spring recess 169 configured to house the spring 180 for the striker sear 168.

Figure 14:
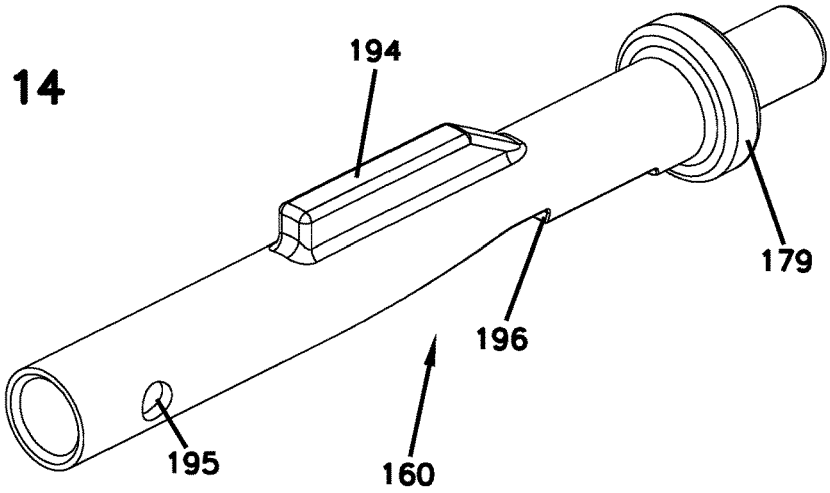
FIG. 14 illustrates a front perspective view of a striker head, according to one embodiment of the present disclosure.
Figure 15:
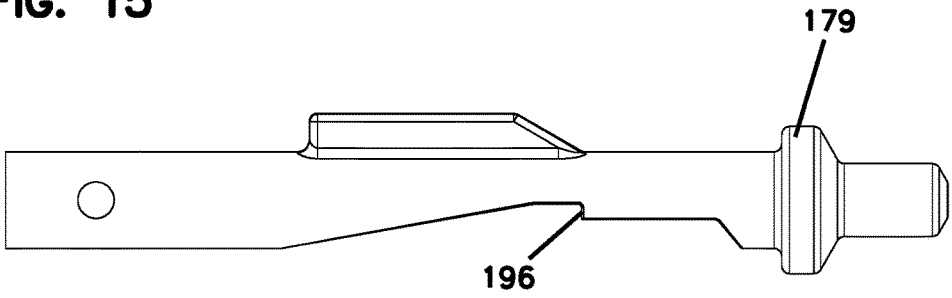
FIG. 15 illustrates a side view of the striker head of FIG. 14.
Figure 16:
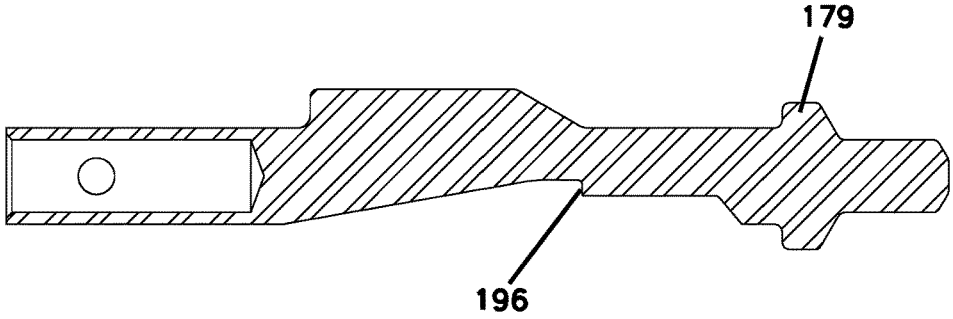
FIG. 16 illustrates a longitudinal cross-sectional view of the striker head of FIG. 14.

FIGS. 14 and 15 show an example of the striker head 160. FIG. 16 shows a longitudinal cross-section of the striker head 160. The striker head 160 is shown as including the flange 179, a key 194, an aperture 195, and a striker sear engagement surface 196. The aperture 195 can be used to fix the striker head 160 to the striker shaft 158. The key 194 is configured to be received by the keyed slot 193 of the striker cam 166. The key 194 and the keyed slot 193 help to prevent the striker head 160 and the striker cam 166 from rotating about one another.

Figure 19:
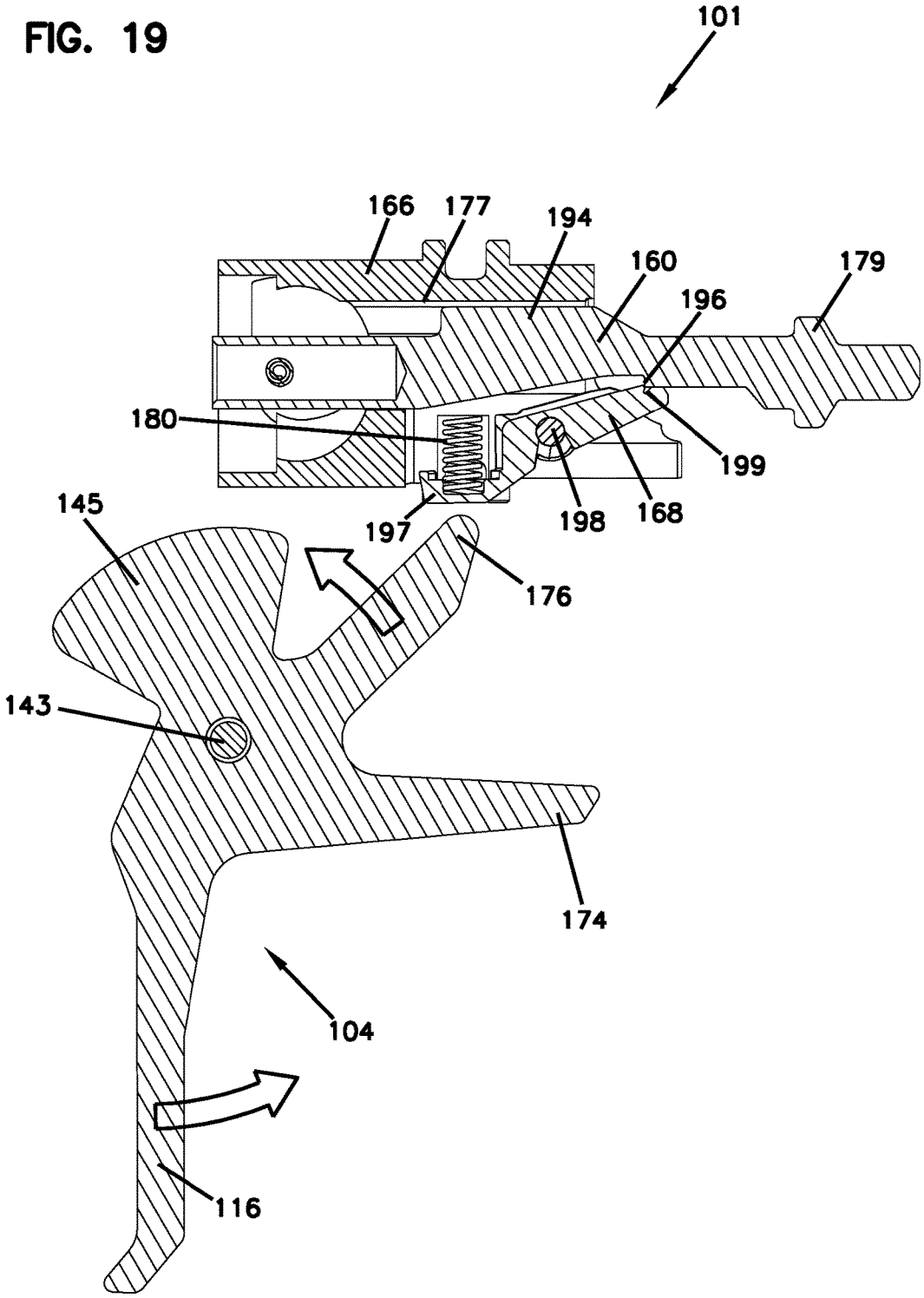
FIG. 19 illustrates a schematic view of a firing mechanism in a primed position, according to one embodiment of the present disclosure.

The striker sear engagement surface 196 is positioned at a bottom of the striker head 160, and is configured to engage a portion of the striker sear 168 when the striker head 160 is in the primed position (see FIG. 19). In some examples, the striker sear engagement surface 196 is disposed across the entire width of the striker head 160. In other examples, the striker sear engagement surface 196 is disposed across a portion of the width of the striker head 160.

Figure 17:
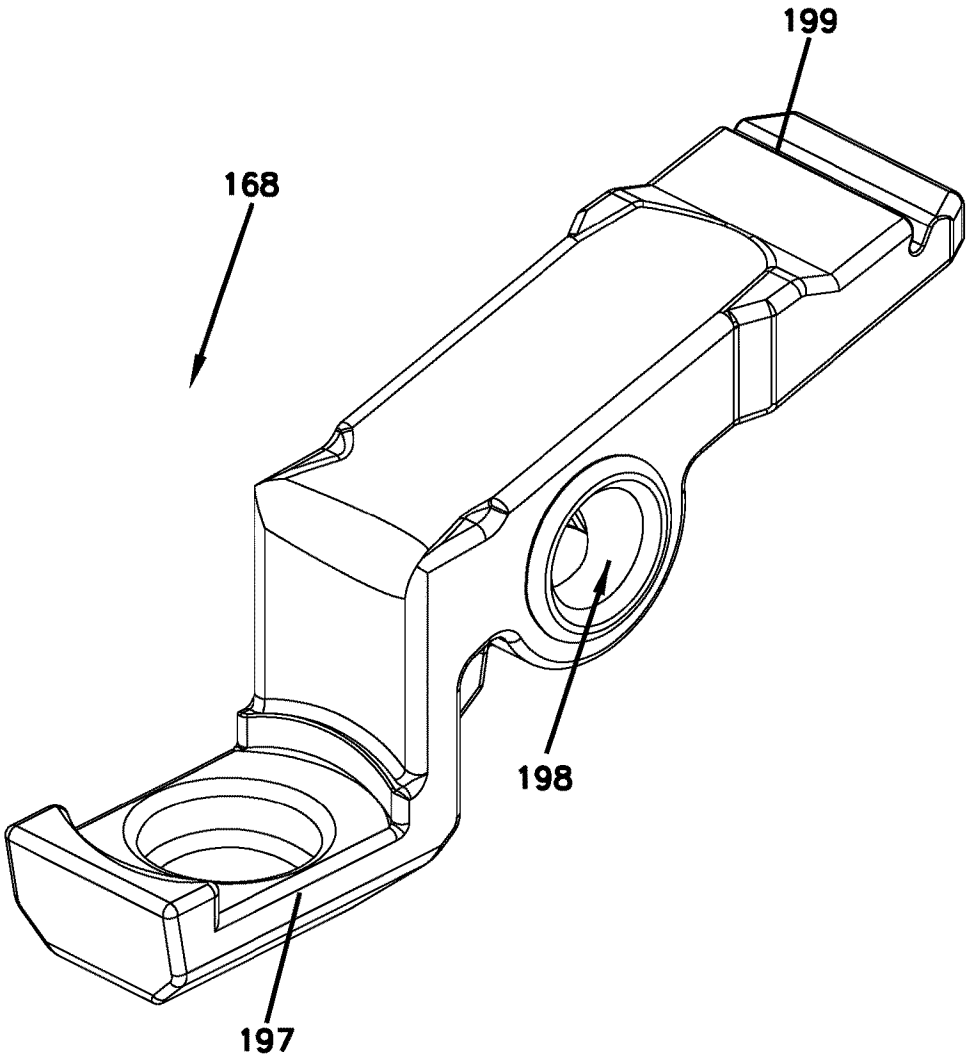
FIG. 17 illustrates a front perspective view of a striker sear, according to one embodiment of the present disclosure.
Figure 18:
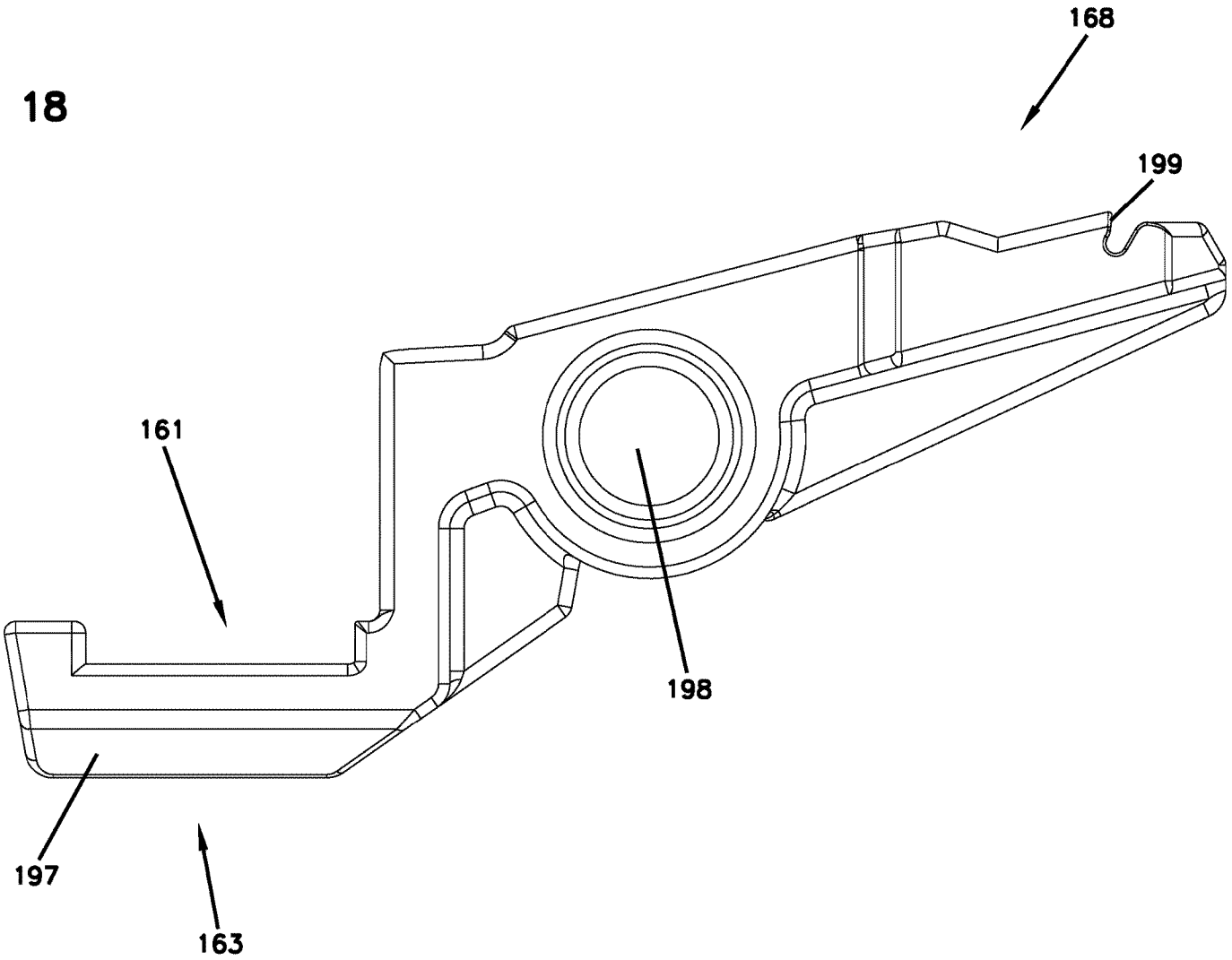
FIG. 18 illustrates a side view of the striker sear of FIG. 17.

FIGS. 17 and 18 show the striker sear 168. The striker sear 168 includes a trigger engagement arm 197, a striker sear pin aperture 198, and a striker head engagement surface 199. The trigger engagement arm 197 is configured to interface with the spring 180 that is positioned within the spring recess 169 of the striker cam 166.

The trigger engagement arm 197 allows the spring 180 to transfer forces from a top side 161 to the striker sear 168, thereby spring loading the striker sear's rotation about the striker sear pin aperture 198. The trigger engagement arm 197 is also configured to receive a force from the trigger mechanism 104, specifically the trigger sear arm 176, at a bottom side 163. The striker sear pin aperture 198 is configured to receive a pin (or bolt or other similar cylindrical device) so as to pivotally attach the striker sear 168 by way of the striker sear pivot aperture 190 within the slot 189 of the striker cam 166.

The striker head engagement surface 199 is configured to interface with the striker sear engagement surface 196 of the striker sear 168 so as to retain the striker head 160 in the primed position. As will be described in more detail with respect to FIGS. 19-21, the striker head engagement surface 199 can be released from the striker sear engagement surface 196 of the striker sear 168 by receiving a force at the bottom side 163 of the trigger engagement arm 197, thereby causing the trigger engagement arm 197 to rotate toward the striker head 160, which thereby lowers the striker head engagement surface 199, and thus separates the striker head engagement surface 199 from the striker sear engagement surface 196.

Figure 20:
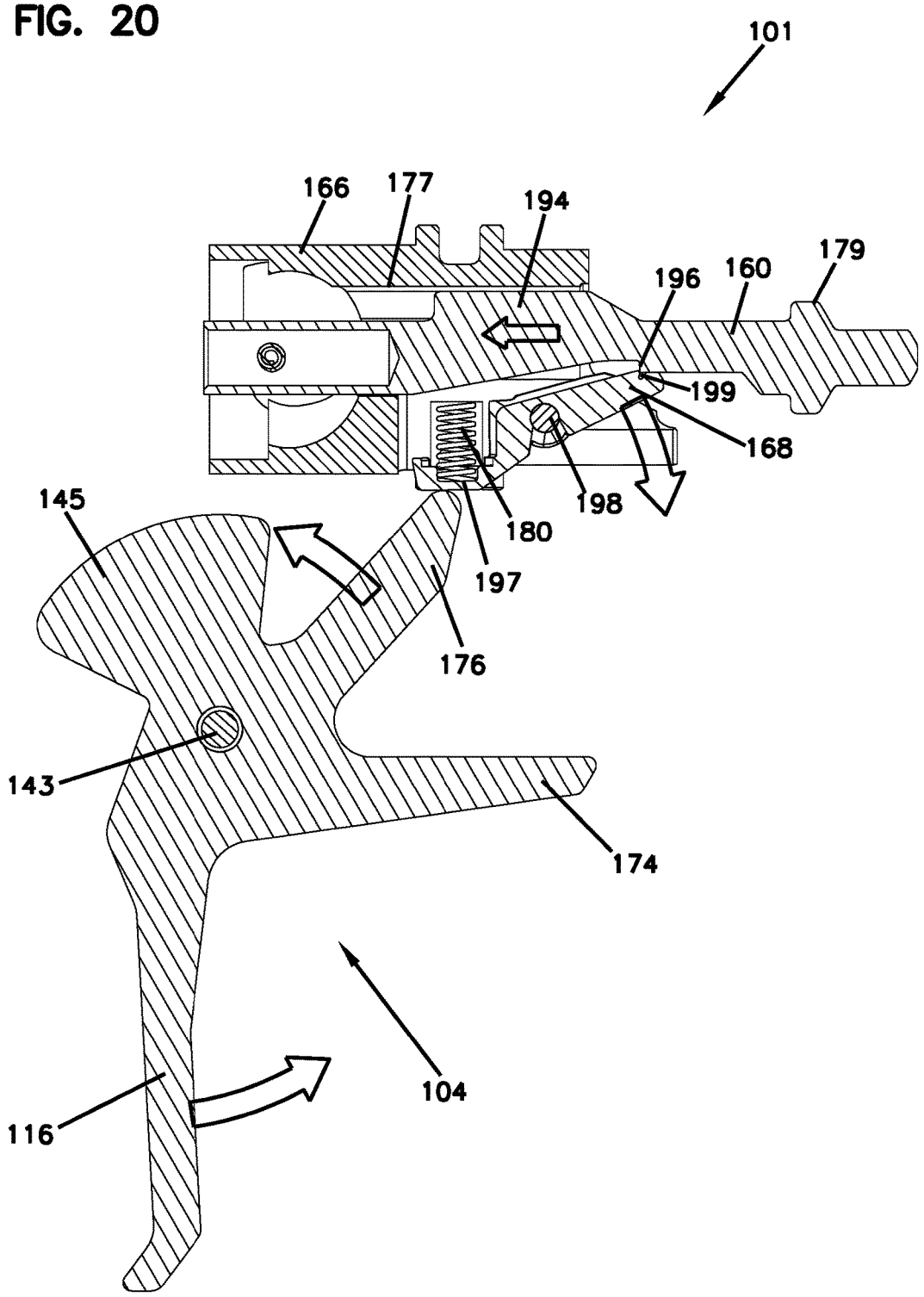
FIG. 20 illustrates a schematic view of the firing mechanism of FIG. 19 in an intermediate position.
Figure 21:
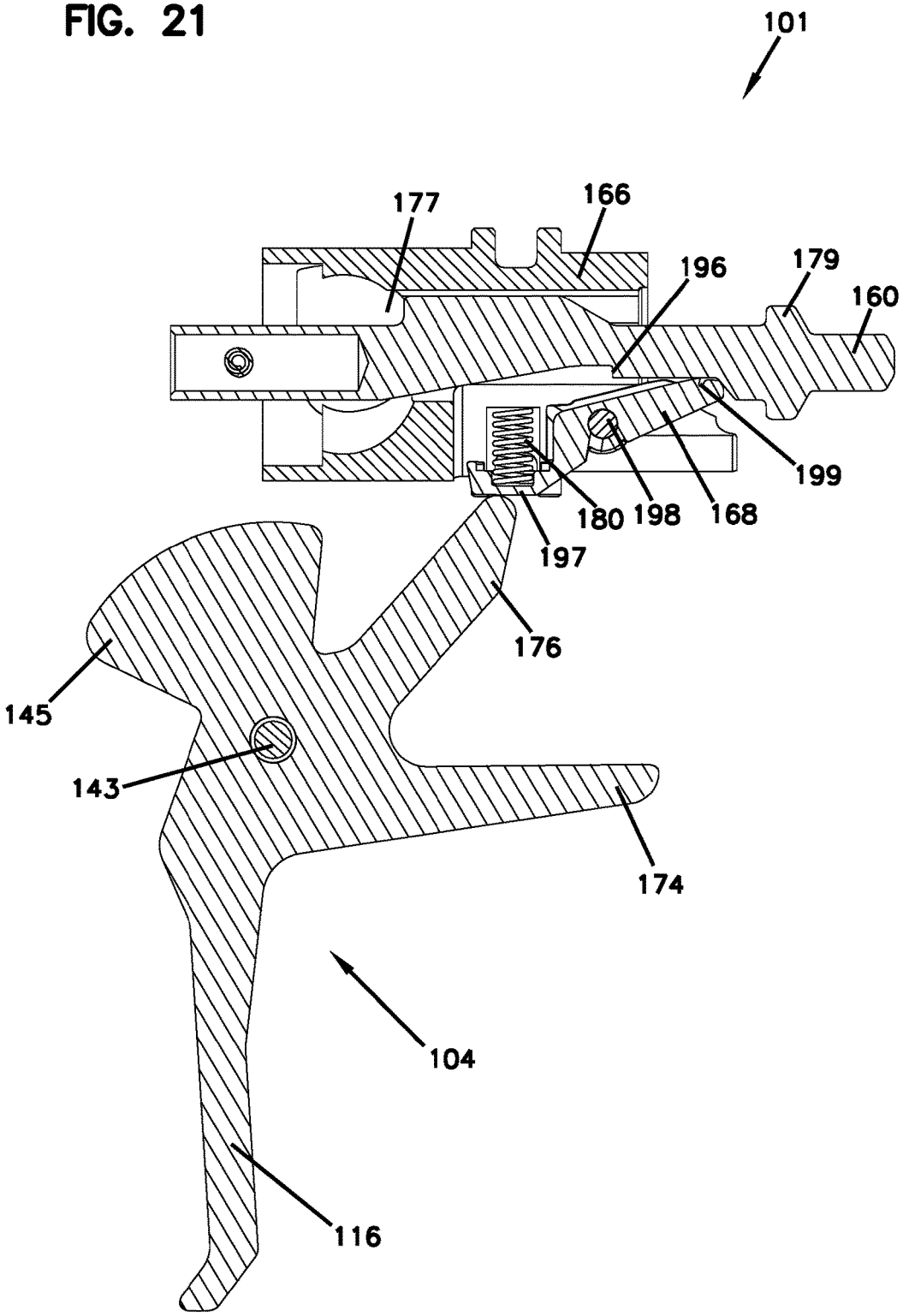
FIG. 21 illustrates a schematic view of the firing mechanism of FIG. 19 in a fired position.

An example of the movement of the firing mechanism 101 (which includes the trigger mechanism 104, striker head 160, striker sear 168, and striker cam 166) during the firing cycle is shown in FIGS. 19-21. FIG. 19 shows the firing mechanism 101 in the primed position, FIG. 20 shows the firing mechanism 101 in an intermediate position, and FIG. 21 shows the firing mechanism 101 in the fired position.

One or more of the pivotable elements of the trigger mechanism 104 can include one or more contact surfaces on which one or more of the other pivotable or movable elements can selectively contact or slide. In the depicted example, the interactions can include surface-to-surface contacts between elements of the trigger mechanism 104 and the striker sear 168.

In at least one example, the trigger mechanism 104 and striker sear 168 combine to provide a two-stage trigger that allows for a smooth first stage resistance and a light, crisp second stage resistance, which causes the firearm 100 to be discharged once the two resistances are overcome. A two-stage trigger affords the user a higher level drop protection as both the resistances need to be overcome to discharge the firearm 100.

The trigger mechanism 104 is pivotable about a trigger pin 143. The trigger mechanism 104 includes the trigger bow 116, the safety arm 174, the trigger sear arm 176, and a trigger weight 145. The trigger weight 145 helps to balance the trigger mechanism 104 and can be altered to achieve a particular balance of the trigger mechanism 104. The trigger mechanism 104 can also include a trigger spring (not shown) so as to bias the trigger mechanism 104 toward the primed position (as shown, for example, in FIG. 19) and to aid in maintaining a particular trigger pull weight.

The safety mechanism 106, as shown in FIG. 6, is configured to disengage and engage the safety arm 174 of the trigger mechanism 104 to alter the operating mode of the firearm 100. When in the safe position, the safety mechanism 106 prevents the trigger mechanism 104 from rotating toward the striker sear 168 by interfacing with the safety arm 174.

The trigger sear arm 176 of the trigger mechanism 104 is configured to interact with the striker sear 168. The trigger sear arm 176 is positioned so that when the trigger mechanism 104 is in the primed position, as shown in FIG. 19, the trigger sear arm 176 and the trigger engagement arm 197 of the striker sear 168 are spaced away from one another so that they are not in contact. This space provides the first stage of the trigger pull and also allows the trigger mechanism to be moved slightly (i.e., jostled) without engaging the striker sear 168.

As noted above, FIG. 19 shows an example of the trigger mechanism 104, striker head 160, striker sear 168, and striker cam 166 in the primed position. The striker head 160 is retained at the striker sear engagement surface 196 by the striker head engagement surface 199 of the striker sear 168. The striker sear 168 and striker head 160 are separately balanced and retained within the striker cam 166 from the trigger mechanism 104. This configuration eases manufacturing and installation, reduces the amount of high tolerances that must be held in order to maintain a light trigger pull, and also decreases the chance of an accidental discharge.

When the user decides to discharge the firearm, the user pulls the trigger bow 116, thereby rotating the trigger mechanism 104 about the trigger pin 143. As shown in FIG. 20, the user completes the first stage of the trigger pull when the trigger sear arm 176 contacts the striker sear 168 at the trigger engagement arm 197. To complete the discharge, the user must then overcome the force of the spring 180 so as transfer a force to compress the spring 180, which causes the striker head engagement surface 199 of the striker sear 168 to rotate away from the striker head 160, thereby causing the striker head 160 to be released. Overcoming this spring force provides the second stage of the trigger pull. The trigger weight can be adjusted by altering the spring weights of the trigger spring (not shown) in contact with the trigger mechanism 104 and the spring 180 of the striker sear 168.

Once released, as shown in FIG. 21, the striker head 160 travels within the central bore 177 of the striker cam 166 by way of a pulling force from striker spring 162. As the striker head 160 moves, it passes over the striker sear 168. To reset the striker head 160 into the primed position, as described above, the bolt assembly 150 is rotated, which moves the striker head 160 toward the rear 132 of the firearm 100 until the striker head engagement surface 199 of the striker sear 168 catches the striker sear engagement surface 196 of the striker head 160. Once released, the trigger mechanism 104 resets to the primed position, thereby again creating a space between the trigger sear arm 176 and the striker sear 168. To fire consecutive rounds of ammunition, the user slides the bolt assembly 150 toward the rear 132 of the firearm 100 with respect to the receiver 102 so as to remove the spent cartridge before pulling the trigger bow 116 again to discharge the next round.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

We claim:

1. A firing mechanism for a firearm, the firing mechanism comprising:

a housing having a central bore and a striker sear slot;

a striker sear pivotally connected to the housing and positioned within the striker sear slot, the striker sear having a striker head engagement surface;

a striker head movably positioned within the central bore, the striker head having an aperture and a striker sear engagement surface configured to interface with the striker head engagement surface of the striker sear; and a striker shaft having an aperture aligned with the striker head aperture, wherein the striker head and striker shaft are configured to be fastened together through the striker head aperture and striker shaft aperture.

2. The firing mechanism of claim 1, wherein the housing is generally cylindrical.

3. The firing mechanism of claim 1, wherein the striker head includes a key, and wherein the housing is keyed to accept the key of the striker head.

4. The firing mechanism of claim 1, wherein a rear surface of the housing comprises at least one ramp and at least one indentation.

5. The firing mechanism of claim 4, further comprising a striker priming ring positioned around the striker head and engaged with the rear surface of the housing, the striker priming ring having at least one protrusion configured to interface with the at least one ramp and at least one indentation of the rear surface.

6. The firing mechanism of claim 1, wherein the striker sear is spring loaded within the housing and biased to a primed position.

7. The firing mechanism of claim 6, wherein when the striker sear is in the primed position, the striker head engagement surface engages with the striker sear engagement surface.

8. The firing mechanism of claim 7, wherein the striker sear includes a trigger engagement surface, and the striker sear is rotatable about a striker sear pin away from the primed position when a force is received at the trigger engagement surface.

9. A firearm comprising the firing mechanism of claim 1.

10. A firing mechanism for a firearm, the firing mechanism comprising:

a trigger sear that is spring biased toward a primed position;

a striker housing having a central bore and a striker sear slot;

a striker sear pivotally connected to the striker housing and positioned within the striker sear slot, the striker sear having a striker head engagement surface and trigger sear engagement surface, wherein the trigger sear engagement surface is configured to receive a force from the trigger sear;

a striker head movably positioned within the central bore, the striker head having an aperture and a striker sear engagement surface configured to interface with the striker head engagement surface of the striker sear, and a striker shaft having an aperture aligned with the striker head aperture, wherein the striker head and striker shaft are configured to be fastened together through the striker head aperture and striker shaft aperture;

wherein when the trigger sear is in a primed position, the trigger sear and the trigger sear engagement surface of the striker sear are spaced away from one another.

11. The firing mechanism of claim 10, further comprising a striker priming ring positioned around the striker head and engaged with a rear surface of the striker housing, the striker priming ring having at least one protrusion configured to interface within at least one ramp and at least one indentation of the rear surface.

12. The firing mechanism of claim 10, wherein the striker sear is spring loaded within the housing and biased to a primed position, and wherein when the striker sear is in the primed position, the striker head engagement surface engages with the striker sear engagement surface of the striker head.

13. A firearm comprising the firing mechanism of claim 10.

14. A bolt-action firearm comprising:

a receiver for housing a bolt therein;

a stock mounted to a rearward end of the receiver;

a barrel mounted to a forward end of the receiver;

a trigger sear mounted in the receiver, the trigger sear being spring biased toward a primed position;

a striker housing having a central bore and a striker sear slot, the striker housing being mounted to a rearward end of the bolt;

a striker sear pivotally connected to the striker housing and positioned within the striker sear slot, the striker sear having a striker head engagement surface and trigger sear engagement surface, wherein the trigger sear engagement surface is configured to receive a force from the trigger sear;

a striker head movably positioned within the central bore, the striker head having an aperture and a striker sear engagement surface configured to interface with the striker head engagement surface of the striker sear, and a striker shaft having an aperture aligned with the striker head aperture, wherein the striker head and striker shaft are configured to be fastened together through the striker head aperture and striker shaft aperture;

wherein, when the trigger sear is in a primed position, the trigger sear and the trigger engagement surface of the striker sear are spaced away from one another.

15. The bolt-action firearm of claim 14, further comprising a striker priming ring positioned in the receiver and around the striker head and engaged with a rear surface of the striker housing, the striker priming ring having at least one protrusion configured to interface within at least one ramp and at least one indentation of the rear surface.

16. The bolt-action firearm of claim 15, wherein the striker priming ring is spring loaded within the receiver.

17. The bolt-action firearm of claim 14, wherein the striker housing is generally cylindrical.

18. The bolt-action firearm of claim 14, wherein the striker head includes a key, and the striker housing is keyed to accepted the key of the striker head.

19. The firing mechanism of claim 10, further comprising a pivotable trigger mechanism, wherein the trigger mechanism includes the trigger sear and a trigger bow, the trigger bow being configured to interface with a hand of a user.

20. The firing mechanism of claim 14, further comprising a pivotable trigger mechanism, wherein the trigger mechanism includes the trigger sear and a trigger bow, the trigger bow being configured to interface with a hand of a user.

21. A firing mechanism for a firearm, the firing mechanism comprising:

a generally cylindrical housing having a central bore and a striker sear slot;

a striker sear pivotally connected to the housing and positioned within the striker sear slot, the striker sear having a striker head engagement surface; and a striker head movably positioned within the central bore, the striker head having a striker sear engagement surface configured to interface with the striker head engagement surface of the striker sear;

wherein a rear surface of the generally cylindrical housing comprises at least one ramp adjacent to an indentation.

22. A firearm comprising the firing mechanism of claim 21.

* * * * *